US007168968B1

(12) United States Patent
Li

(10) Patent No.: US 7,168,968 B1
(45) Date of Patent: Jan. 30, 2007

(54) PLUG ADAPTER

(75) Inventor: Chen-Yu Li, Taoyuan (TW)

(73) Assignee: SPI Electronic Co., Ltd. (TW)

( * ) Notice: Subject to any disclaimer, the term of this patent is extended or adjusted under 35 U.S.C. 154(b) by 0 days.

(21) Appl. No.: 11/266,294

(22) Filed: Nov. 4, 2005

(51) Int. Cl.
*H01R 29/00* (2006.01)

(52) U.S. Cl. ..... 439/172; 439/518

(58) Field of Classification Search ..... 439/172, 439/171, 173, 518
See application file for complete search history.

(56) References Cited

U.S. PATENT DOCUMENTS 2,284,231 A * 5/1942 Price ..... 439/172
2,323,736 A * 7/1943 Tousley ..... 439/103
2,611,068 A * 9/1952 Wellens ..... 392/392
2,634,344 A * 4/1953 Robinson, Jr. et al. .. 200/51.07
2,989,719 A * 6/1961 Aarlaht ..... 439/103
3,025,486 A * 3/1962 Falconer ..... 439/103
5,474,464 A * 12/1995 Drewnicki ..... 439/172
5,684,689 A * 11/1997 Hahn ..... 363/146
6,592,386 B2 * 7/2003 Teng et al. ..... 439/172
6,669,495 B2 * 12/2003 Philips et al. ..... 439/170
6,923,667 B1 * 8/2005 Chen ..... 439/172

* cited by examiner

*Primary Examiner*—Tulsidas C. Patel
*Assistant Examiner*—Vladimir Imas
(74) *Attorney, Agent, or Firm*—Birch, Stewart, Kolasch & Birch, LLP

(57) ABSTRACT

A plug adapter includes a holder and a plug. An adaptation ring is provided on the holder; the adaptation ring containing multiple gaps. A mounting plate from the plug is snapped into the adaptation ring and turns in a given direction. The mounting plate is secured in place by pressing a push for the plug to engage with the holder. The push may also be pressed to turn the mounting plate in an opposite direction, causing the plug to disengage from the holder to facilitate replacement of the plug with another plug of differing specification.

5 Claims, 9 Drawing Sheets

PLUG ADAPTER

BACKGROUND OF THE INVENTION

1. Field of the Invention

The present invention is related to a plug adapter, and more particularly, to one that allows replacement among plugs of different specifications by engaging and disengaging the holder with and from the plug.

2. Description of the Prior Art

So far there are six different plug specifications generally used in the world. Some of those specifications are intentionally made different due to the voltage of the city power varying, and others, although operating on the same voltage, differ from each other as safety specification varies by country. Accordingly, when traveling around the world either for sightseeing or for official business, one will usually check out the specifications for the plug in the country of destination so to prepare the right adapter for the small electric appliances which may be used there. Of course, some electric appliances will make several plugs of different specifications available for replacement in use, to make them minimally subject to the limits of the plug prescribed depending on the individual nation.

As illustrated in FIG. 1 of the accompanying drawings, a plug adapter of the prior art essentially has a sliding trough 11 disposed on a holder 10, a plug 20 provided on a slide 30, a locking hole 31 disposed in the slide, and a mating catch 12 for the locking hole disposed on the holder 10. Accordingly, the slide 30 is inserted into the sliding trough 11 to position, the catch 12 and the locking hole 31 are locked to each other to restrict the slide 30, and the plug 20 is secured in the holder 10. However, in practice, the slide 30 could easily escape from its position due to any accidental touch, as the catch 12 may fail to be securely engaged between the holder and the plug.

SUMMARY OF THE INVENTION

The primary purpose of the present invention is to provide a plug adapter that provides a secured engagement between a holder and a plug to facilitate replacement among plugs of different specifications. To achieve the purpose, the present invention is comprised of a holder and a plug. The holder is essentially comprised of an insulation cover and a circular adaptation ring. Multiple gaps are disposed on outer circumference of the adaptation ring and multiple arc key are disposed by the side of two neighboring gaps, with a blocking side disposed on one end of each arc key. A pair of contacts to be coupled to the plug is provided within the adaptation ring. A push is disposed close to the adaptation ring. The plug includes an insulation mounting plate attached with two blades and a retaining ring. The mounting plate is provided with multiple protruded sections and multiple slots. Two through holes are disposed so as to be exactly aligned at the plug on the retaining ring, in order to permit both contacts to pass through.

Accordingly, the protruded sections of the plug are placed in the gaps and turned in a given direction on the adaptation ring. The protruded sections slide in the arc keys until stopped by the blocking sides of the arc keys, and is then secured in place when the push is pressed for the plug to engage with the holder. To replace with another plug of different specification, the push is simply pressed and the mounting plate of the plug is turned so as to disengage the plug from the holder.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
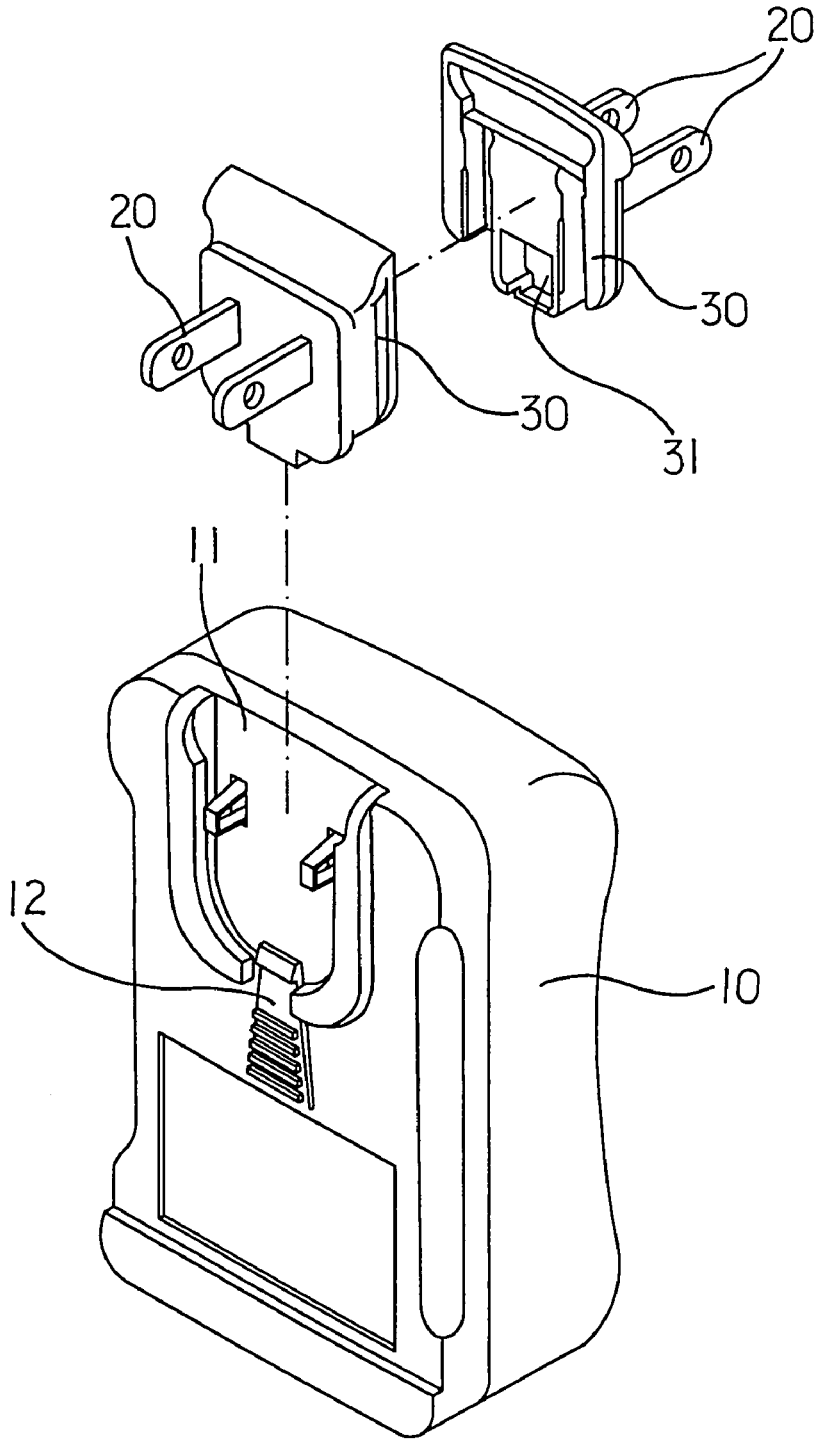
FIG.1 Prior Art
FIG. 1 is an exploded view showing a plug adapter of the prior art.
Figure 2:
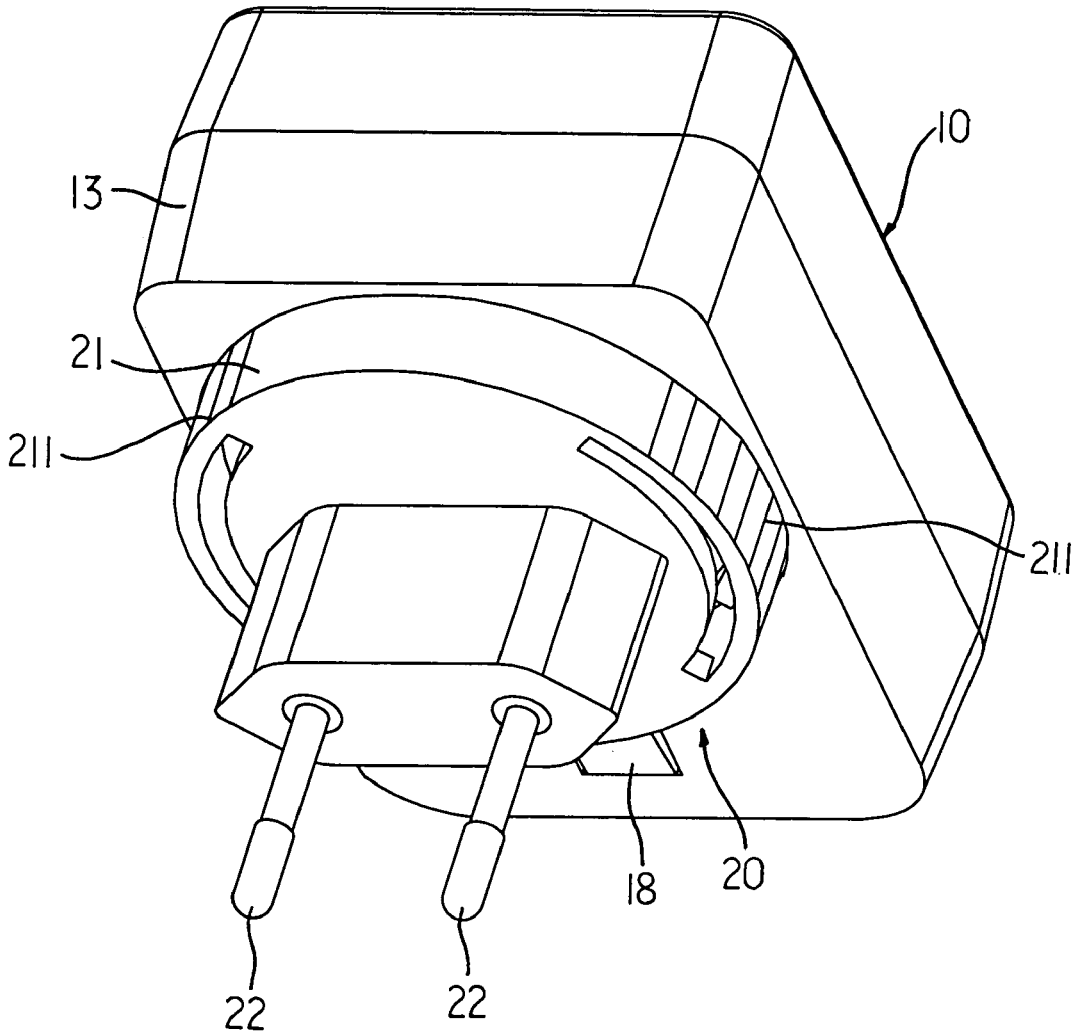
FIG. 2 is a view showing the appearance of a plug adapter of the present invention.
Figure 4:
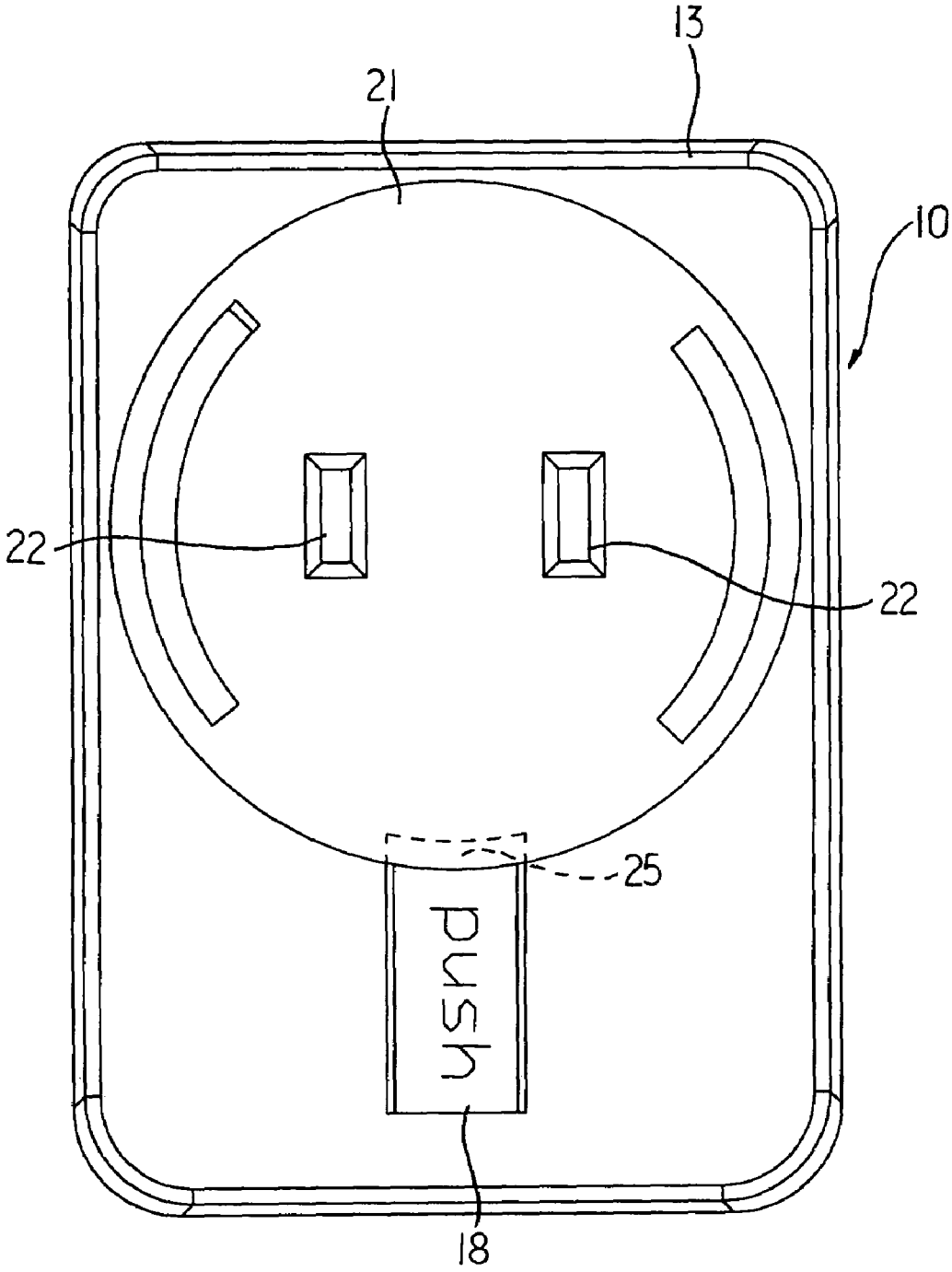
FIG. 4 is a schematic view of a construction of the present invention.

A plug adapter of the present invention is related to a coupling construction between a holder to be adapted with a plug for use and multiple plugs of different specifications as illustrated in FIGS. 2 and 4. The plug adapter of the present invention includes a holder 10 and a plug 20. The holder includes an insulation cover (comprised of an upper casing and a lower casing engaged to each other). A circular adaptation ring 14 is provided on one side of the insulation cover 13. Multiple gaps 15 are disposed by the side of the adaptation ring 14, and an arc key 16 is disposed between two gaps 15 with one end of the arc key 16 formed a blocking side 161. Multiple contacts (two in this preferred embodiment) to couple the plug 20 are provided in the adaptation ring 14, and a push 18 is provided closer to the adaptation ring 14 with one end of the press 18 serving as a locking end for the insulation cover 13 and the other end a free end to protrude from the surface of a gap 15 in normal condition.

The plug 20 includes an insulation mounting plate 21, multiple blades 22 (two in this preferred embodiment to correspond to those two contacts 17) disposed on the mounting plate 21, and a retaining ring 23 disposed beneath the mounting plate 21. The retaining ring is fastened to the mounting plate 21 by means of a screw 26. Multiple sections 24 each are provided at and protruding from the enclosing wall of the mounting plate 21 to merely insert into those gaps 15, and a slot 25 is provided on one side of the mounting plate to admit the entrance by the push 18. A pair of through holes is disposed on the retaining ring 23 at where exactly aligned at the plug 20 to admit contacts to pass.

Figure 5:
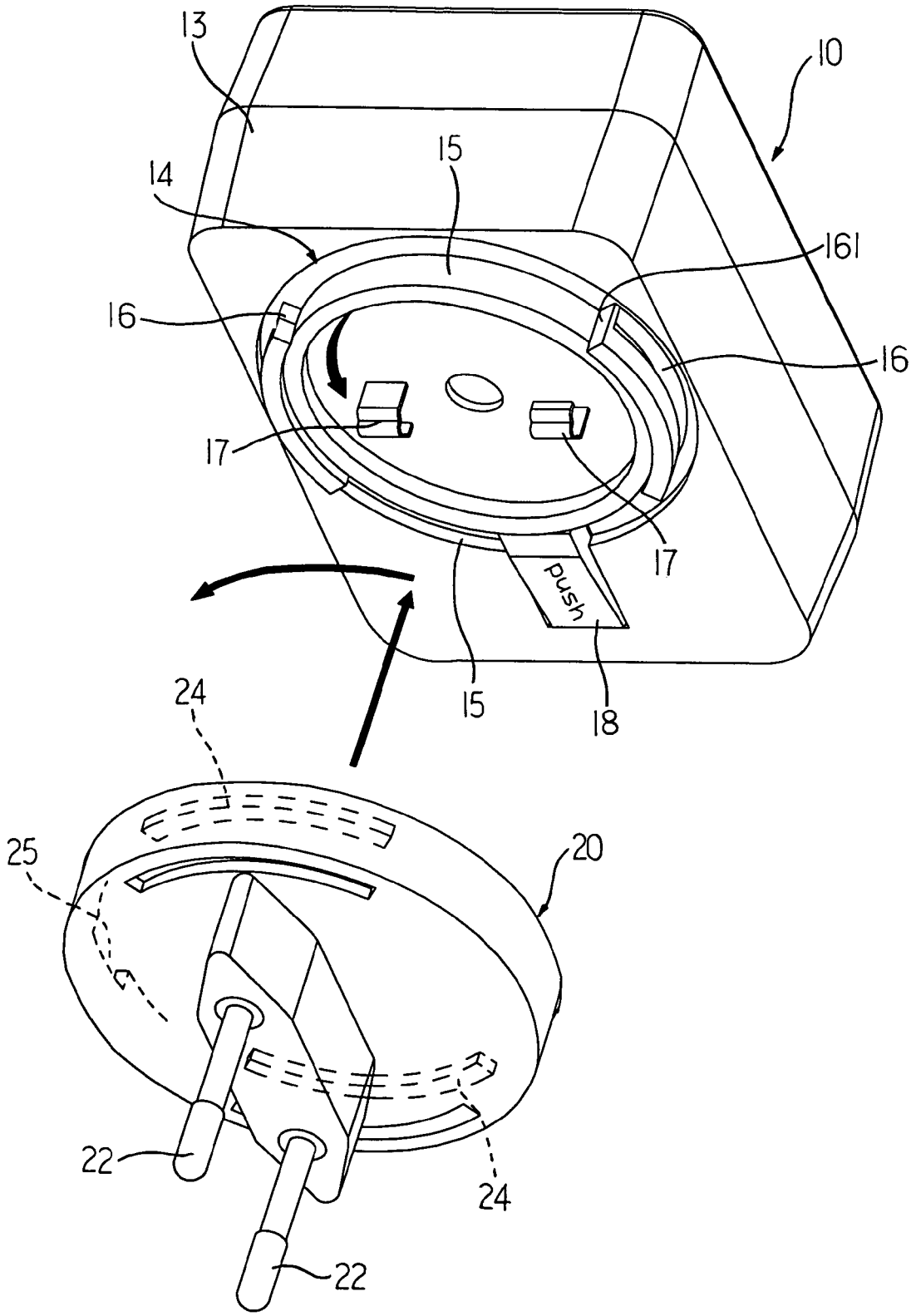
FIG. 5 is a schematic view showing the assembling process of an mounting plate in the present invention.
Figure 6:
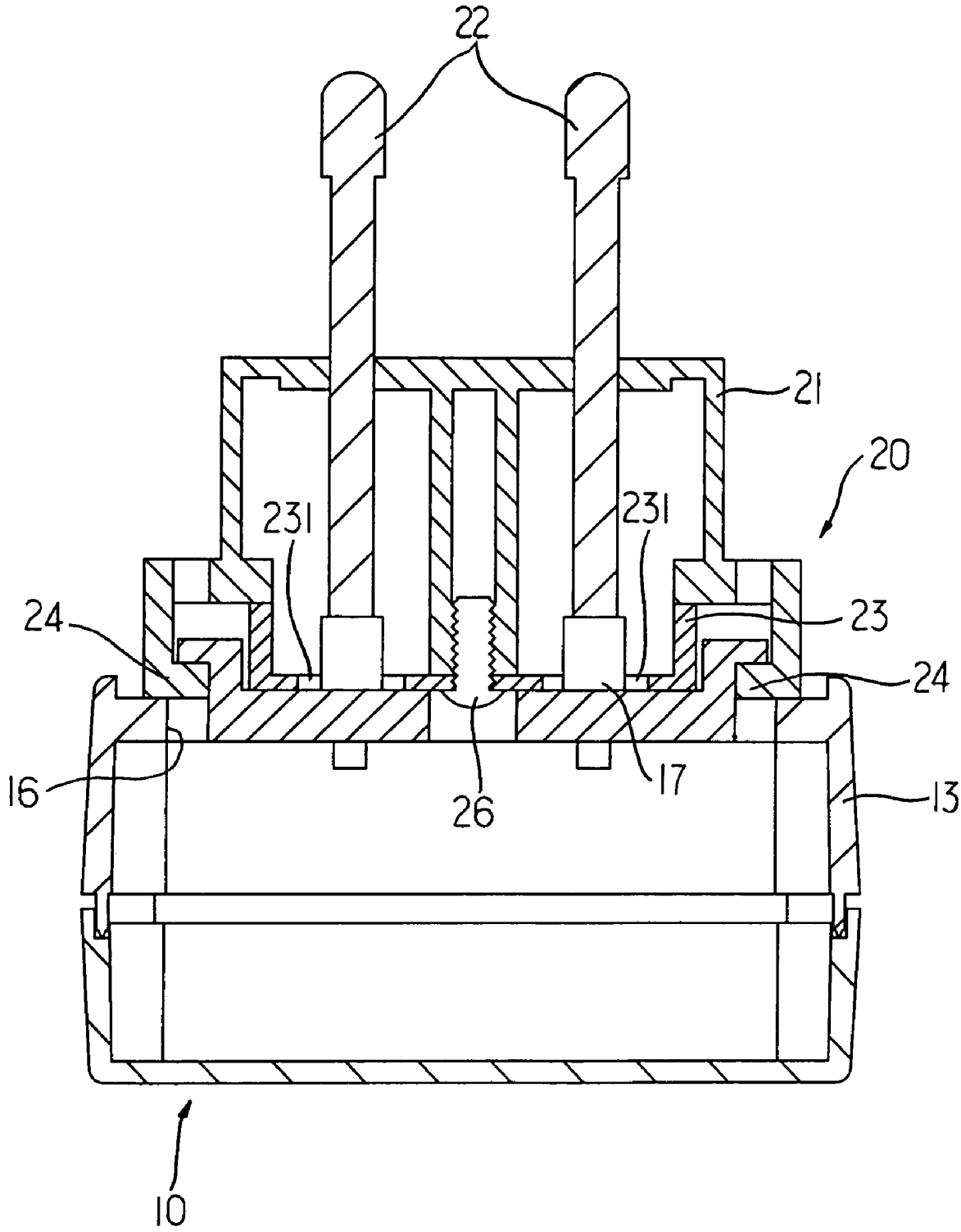
FIG. 6 is a sectional view showing that multiple protruded sections of the mounting plate are snapped into multiple arc keys in the present invention.

As illustrated in FIGS. 5 and 6, with the protruded sections 24 from the mounting plate 21 aligned exactly at their corresponding gaps 15, the plug 20 is engaged with the holder 10 by means of the mounting plate 21. The mounting plate 21 is turned in reverse against the arc key 16 to allow the protruded sections 24 to enter and slide in arc keys 16 until they are stopped by the blocking sides 161 to secure in place. The push 18 is pressed and thereby inserted into the slot 25, to lock the protruded sections 24 of both the plug 20 and the holder 10 to each other, as illustrated in FIG. 7.

Figure 3:
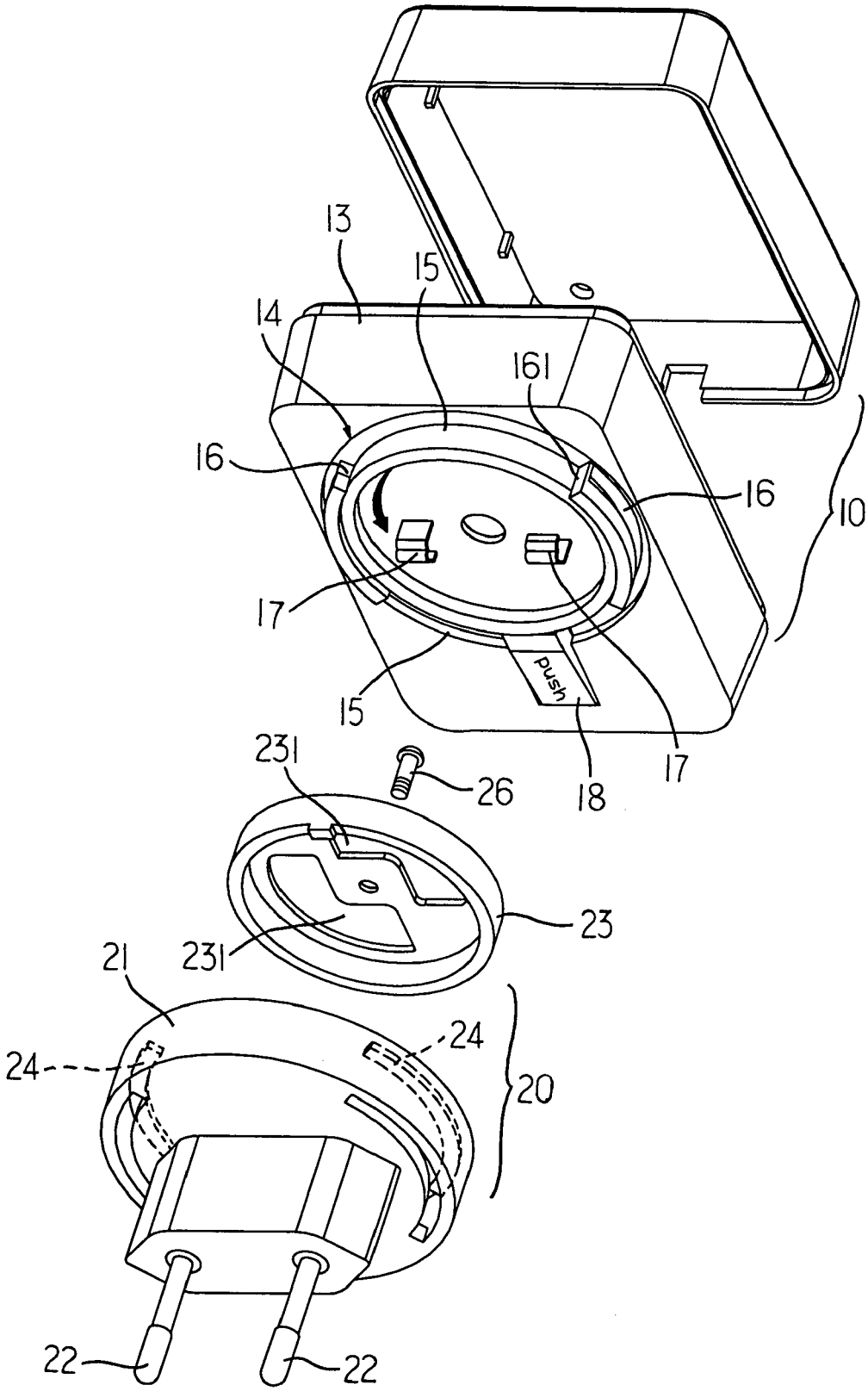
FIG. 3 is an exploded view of the present invention.

Now referring to FIGS. 3 and 6, those contacts 17 from the holder 10 coupled to the plug are provided to correspond to the mounting plate 21 of the plug 20. Once the plug 20 is in position, the holder 10 is connected to the loop of the plug 20. The connection is made possible only when both contacts 17 have passed through both through holes 231 disposed on the retaining ring 23, wherein the retaining ring is exactly aligned at the plug 20, to ensure safe use.

To replace the plug with another plug of different specifications, the push 18 is pressed to clear out the slot 25, and the plug 20 is turned in the opposite direction, in order to eject the protruded sections 24 so that they can move to the where the gaps 15 are provided, whereby the existing plug 20 is disengaged from the holder 10.

Figure 7:
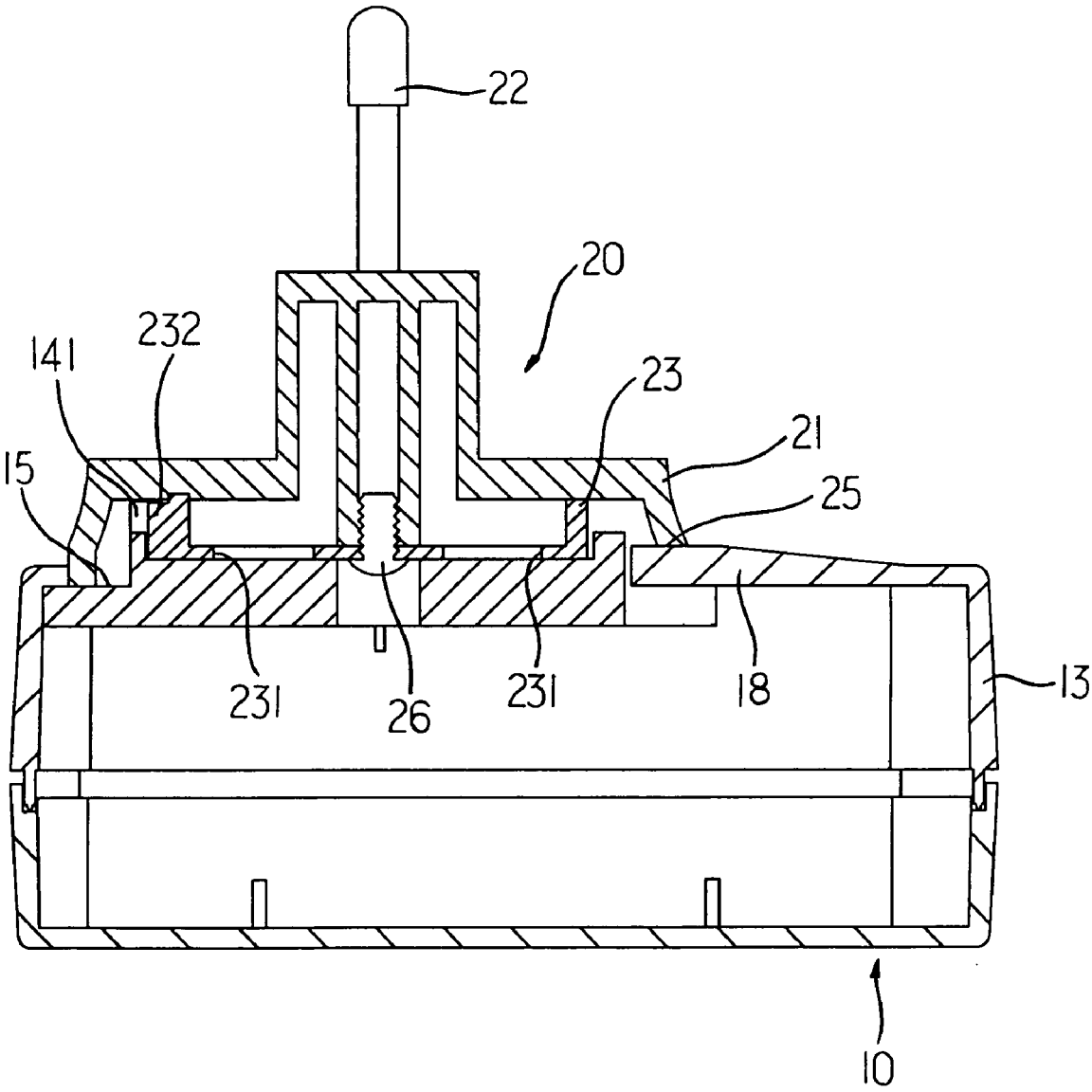
FIG. 7 is a sectional view showing a push penetrating into a slot in the present invention.
Figure 8:
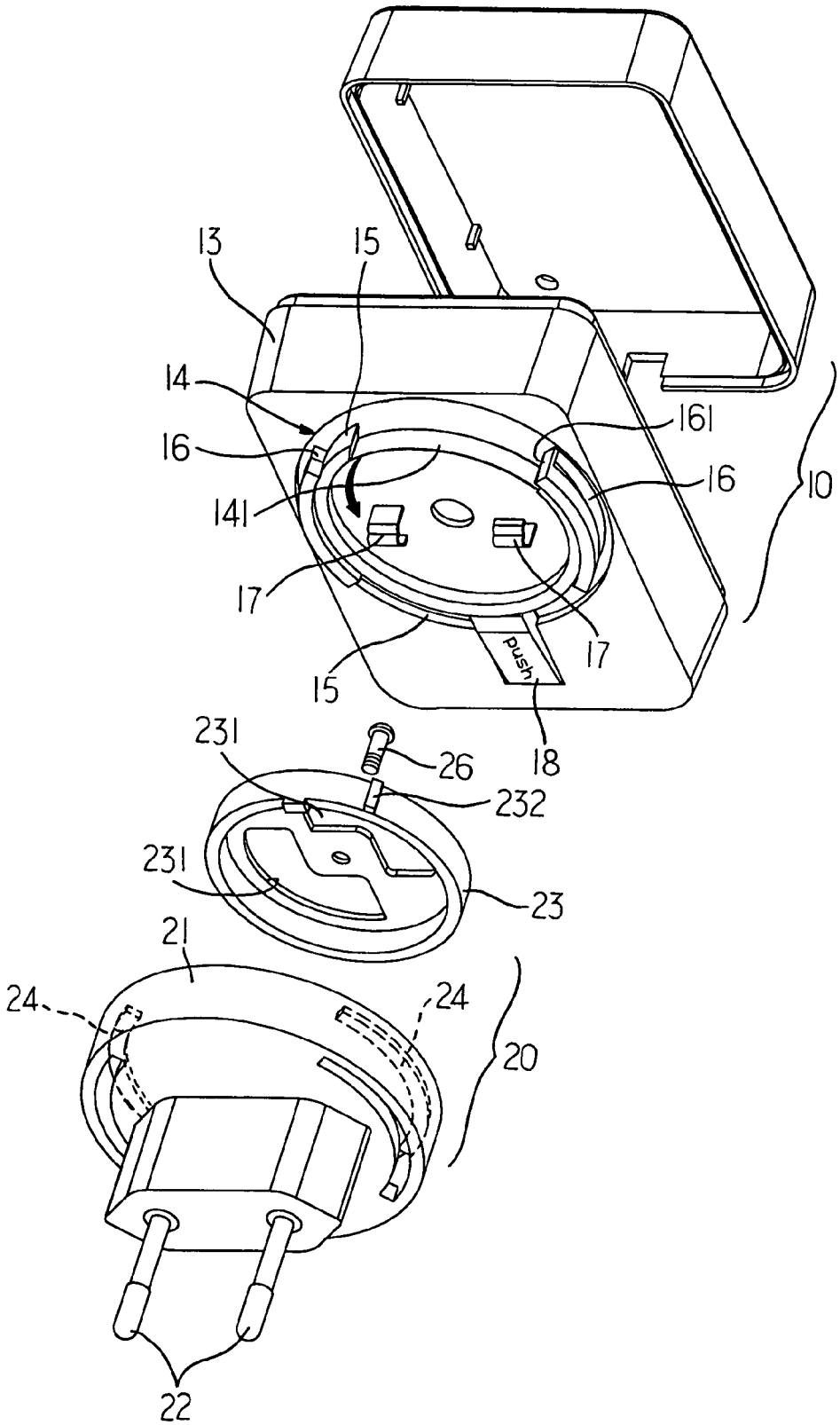
FIG. 8 is an exploded view of another construction of the present invention.
Figure 9:
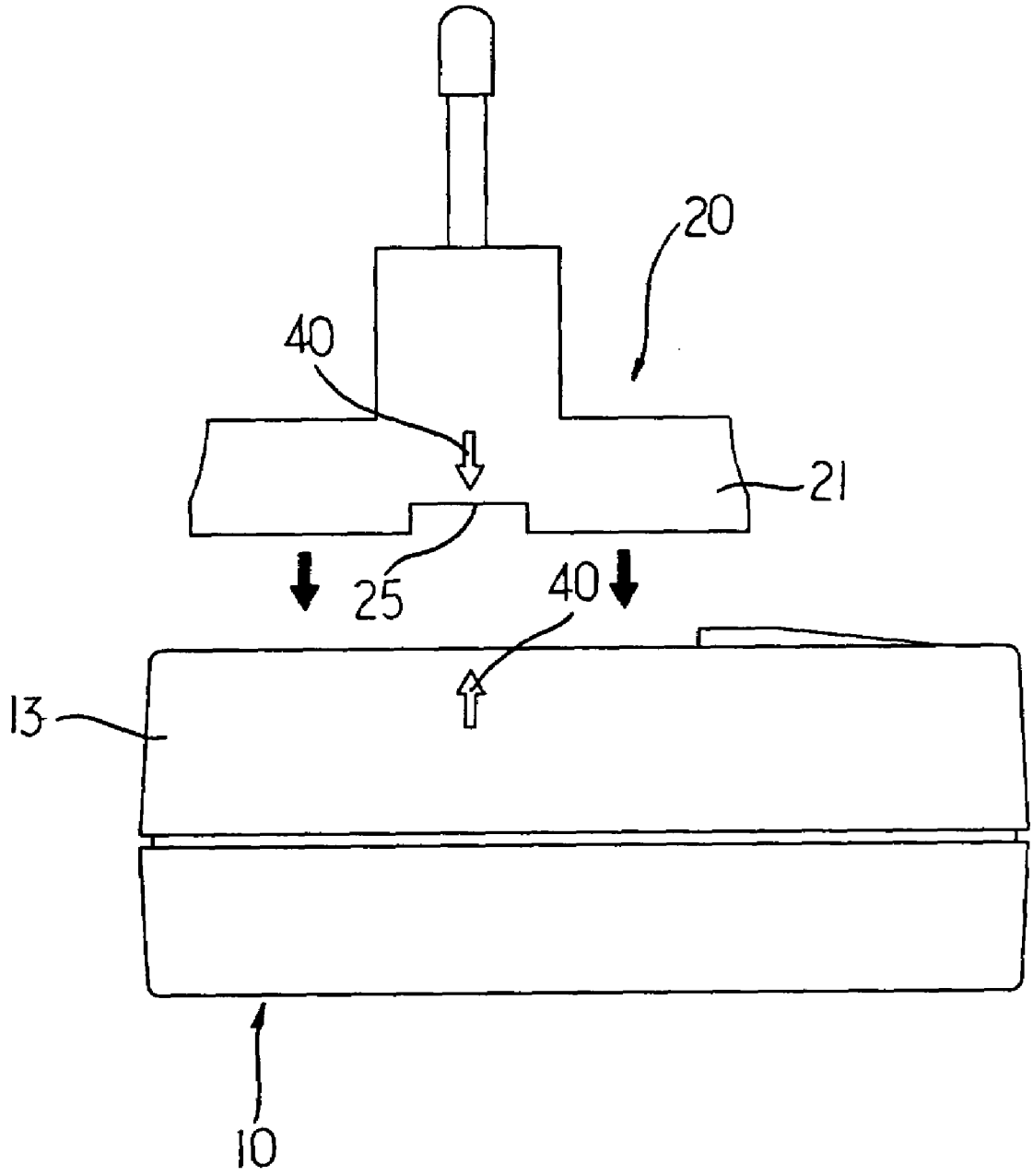
FIG. 9 is a schematic view showing that a matching direction mark is each provided on the holder and the plug.

Furthermore, as illustrated in FIGS. 7 and 8, a locking bit 232 extends externally from the retaining ring 23 and a sliding passage 141 in a fixed path is disposed in the adaptation ring 14 to provide a foolproofing measures since if the locking bit 232 fails to slide within the sliding passage 141, the mounting plate 21 cannot be inserted into the adaptation ring 14 to slide. Of course, a matching direction mark 40, i.e., an arrow, is each provided on the insulation cover 13 and the mounting plate 21 to facilitate the replacement of the plug and to provide a similar foolproofing measure, as illustrated in FIG. 9. Multiple cuts 211 are externally provided to the mounting plate 21 as illustrated in FIG. 2, for a user to more easily grasp the mounting plate for rotation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A plug adapter comprising:

a holder; and a plug, wherein the holder includes an insulation cover with a circular adaptation ring on one side, the adaptation ring having multiple gaps with multiple arc keys being provided between two of the gaps, and wherein the adaptation ring has multiple contacts disposed thereon for coupling with the plug and a push disposed close to the adaptation ring, the push protruding from the surface of the gap in a normal state;

wherein the plug includes a mounting plate and a retaining ring disposed beneath the mounting plate, the mounting plate having multiple blades attached thereto, an enclosing wall of the mounting plate being provided with multiple protruded sections for insertion into the gaps of the adaptation ring, a side of the mounting plate being provided with a slot for penetration by the push, and the retaining ring being exactly aligned with the plug to provide multiple through holes for penetration by multiple contacts of the plug, wherein the adaptation ring has a sliding section, into which a locking bit extending from an outer surface of the enclosing wall of the retaining ring is received and travels.

2. The plug adapter of claim 1, wherein the retaining ring is fastened to the mounting plate by means of a screw.

3. The plug adapter of claim 1, wherein multiple cuts are further provided on the external side of the mounting plate.

4. The plug adapter of claim 1, wherein matching direction marks are provided on each of the insulation cover and the mounting plate.

5. The plug adapter of claim 1, wherein one end of each arc key is provided with a blocking side.

* * * * *